US006336699B1

(12) United States Patent
Sarkissian et al.

(10) Patent No.: US 6,336,699 B1
(45) Date of Patent: Jan. 8, 2002

(54) SELF-CLEANING WET WIPE METHOD AND APPARATUS FOR CLEANING ORIFICES IN AN AIP TYPE PRINTHEAD

(75) Inventors: Shahin Sarkissian; Joy Roy, both of San Jose, CA (US)

(73) Assignee: Xerox Corporation, Stemford, CT (US)

( * ) Notice: Subject to any disclaimer, the term of this patent is extended or adjusted under 35 U.S.C. 154(b) by 0 days.

(21) Appl. No.: 09/448,008

(22) Filed: Nov. 23, 1999

(51) Int. Cl.[7] ..... B41J 2/165
(52) U.S. Cl. ..... 347/33; 347/32
(58) Field of Search ..... 347/33, 29, 31, 347/23, 28, 38, 32

(56) References Cited

U.S. PATENT DOCUMENTS

| | | | | |
|---|---|---|---|---|
| 5,027,134 A | | 6/1991 | Harmon et al. | 347/29 |
| 5,798,775 A | * | 8/1998 | Takahashi et al. | 347/33 |
| 5,856,834 A | * | 1/1999 | Murphy, III | 347/23 |

FOREIGN PATENT DOCUMENTS

DE 30 42 998 A1 * 7/1982

* cited by examiner

*Primary Examiner*—N. Le
*Assistant Examiner*—Shih-Wen Hsieh
(74) *Attorney, Agent, or Firm*—Fay, Sharpe, Fagan, Minnich & McKee, LLP

(57) ABSTRACT

In order to clean a dirty printhead, the dirty printhead is first capped and the ink pressure in the printhead increased significantly to allow ink to escape through the orifices and completely fill a small gap inside the cap portion. After letting the orifices soak for a predetermined time to dissolve the dried ink and loosen dust debris which may be found on the printheads, the cap drainhole is opened to drain the ink while keeping the ink pressure inside the head at an intermediate higher level. Dirty ink remaining inside the orifice bore is removed using a self cleaning wiping station in separate steps. During a first step, the wiping element is pressed into contact with the orifices. The dirty ink, because of the high pressure inside the printhead, is unable to reenter the printhead and is absorbed by the wiping element. In a second step, the pressure inside the printhead is decreased significantly below operating pressures to enable the menisci to retreat inside an orifice lip. Then the orifices are again wiped with another portion of the wiping element to remove any remaining ink and to assist in drying the printhead. Once the printhead has been cleaned, the wiping station is moved out of engagement with the printhead and the wiping station automatically cleans the wiping element by passing the wiping element through the washing fluid and the squeegee element until absorbed ink is removed from the wiping element.

19 Claims, 11 Drawing Sheets

FIG. 4
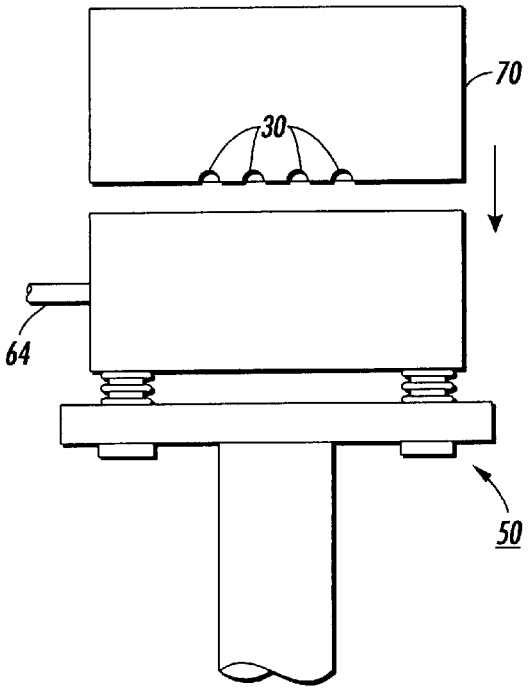
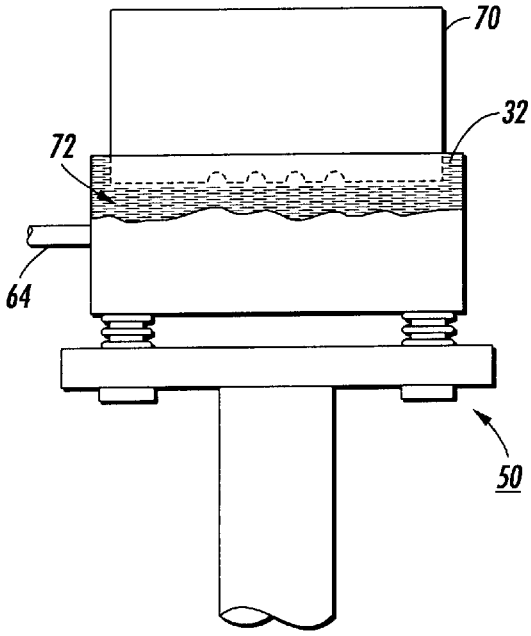
FIG. 5

SELF-CLEANING WET WIPE METHOD AND APPARATUS FOR CLEANING ORIFICES IN AN AIP TYPE PRINTHEAD

BACKGROUND OF THE INVENTION

This invention relates to acoustic ink printing and, more particularly to, a method and apparatus which allows for cleaning and maintaining AIP printheads which implement unique orifice plates, and where a wetted wiping element is cleaned to allow for re-use of the wiping element.

It has been shown that acoustic ink printers which have printheads with emitters, including acoustically illuminated spherical or Fresnel focusing lenses can print precisely positioned picture elements (pixels) at resolutions that are sufficient for high quality printing of complex images. Significant effort has gone into developing acoustic ink printing, see for example, U.S. Pat. Nos. 4,308,547; 4,751,530; 4,697,195; 4,751,530; 4,751,534; 5,028,937; and 5,041,849, all of which are among many commonly assigned to the present assignee.

For performing acoustic printing, each of the emitters of the printhead launches a converging acoustic beam into a pool of ink, with the angular convergence of the beam being selected so that it comes to focus at or near the free surface (i.e., the liquid/air interface) of the pool. Moreover, controls are provided for modulating the radiation pressure which each beam exerts against the free surface of the ink. That permits the radiation pressure from each beam to make brief, controlled excursions to a sufficiently high pressure level to overcome the restraining force of surface tension, whereby individual droplets of ink are emitted from the free surface of the ink on command, with sufficient velocity to deposit them on a nearby recording medium.

A main attraction of acoustic ink printing is the ability to control droplet size based on the frequency of the signal provided, rather than providing on the size of the nozzle emitting the droplet. For example, an AIP printer may emit droplets magnitude in size smaller than the AIP openings. On the other hand, conventional ink jet printing requires a minimization of the nozzle itself to obtain small droplets.

While this is a benefit of AIP type printing, the size of the droplet ejectors used in acoustic ink printing are nevertheless very small. In consideration of this, maintaining the droplet ejectors in a clean state is an extremely important aspect of proper operation. Not only can dirt particles and dust (particularly paper dust) clog the ejector ports, but ejected ink droplets which do not adhere to the recording medium or have such low velocity that they return back to the orifice plate, and can build up enough to disrupt the printing process. Additionally, whereas many conventional ink jet printers require the replacement of the printheads after a somewhat short period of time, AIP printheads can have an indefinite life span. As part of extending this useful life, maintaining the printheads clean is an important aspect.

Existing examples of printhead cleaning are substantially directed to cleaning of printheads configured to use nozzles, whereas acoustic printheads are nozzleless. For nozzle type printheads, a wiper blade is a common device used for cleaning.

However, an ink jet printhead configuration is significantly different from the printhead of an acoustic ink printer. Therefore, attempting to use a wiper blade cleaning device or other cleaning method or apparatus designed for nozzle type printheads will not achieve desired results. For example, use of a wiper blade cleaning device with acoustic ink printheads may result in clogging of the printhead rather than accomplishing the desired cleaning.

It has also been suggested that a non-wiping technique for improving the cleanliness of exposed surfaces of droplet ejectors for a fixed printhead could be used. However, while such a technique has benefits, it is less desirable for moving printheads and also involves significant engineering considerations and is more specifically designed to a fixed printhead situation.

U.S. patent application Ser. No, 09/340,741 entitled METHOD AND APPARATUS FOR CLEANING/MAINTAINING OF AN AIP TYPE PRINTHEAD, filed Jun. 28, 1999 and assigned to the same assignee, describes an apparatus and method of cleaning AIP type printheads. However, the described device only allows a single use of a portion of a cleaning element, such that the cleaning element becomes exhausted.

It has been determined desirable to find a method and apparatus of cleaning/maintaining acoustic ink printheads which have unique orifice plate design in which the ink menisci are maintained at an entrance edge of the orifice plate, defined by a very thin lip. It is also desired that such a method and apparatus be able to clean a cleaning element of the apparatus such that the cleaning element may be re-used.

SUMMARY OF THE INVENTION

In accordance with the present invention, there is provided a method and apparatus for providing in combination or individually a flooding, dry and wet wiping of acoustic ink printheads for maintaining the cleanliness of the exposed surfaces of the printhead. A flooding procedure initially attempts to use the ink of the printhead in the cleaning process. Following the flooding operation ink on the outside surface of the orifice plate is removed by use of wiping over it with a compliant wiper blade. Next, ink inside the orifice bore is removed using a self-cleaning wet wiping station. The wiping station of the present invention consists of a wiping element designed with an absorbent, hydrophilic, compliant material, a washing fluid which wetted the wiping element, and a squeegee which removes excess fluid from the wiping element prior to the cleaning process. The washing fluid and squeegee being further used to clean the wiping element following cleaning of the printhead.

During a first step of the wiping station operation, the wetted wiping element is pushed over the orifices while the printhead and wiping element are moved in opposite directions. The dirty ink, because of a higher pressure inside the printhead, is unable to reenter the printhead and is absorbed by the wiping element. In a following step, pressure inside the printhead is decreased to enable the menisci to retreat inside the lip. When the orifice is again wiped with the wiping element, the remaining ink is removed from the bore of each orifice as well as from the exit surface of the submerged lip, due to absorption into the absorbent material. Subsequent to the second step, the wiping element is passed through wash fluid and squeegeed a number of times until the dirty ink is removed from the wiping element. This procedure cleans the wiping element so that on a subsequent cleaning of the printhead, the wiping element can be reused.

BRIEF DESCRIPTION OF THE DRAWINGS

The invention may take form in various components and arrangement of components, and in various steps and arrangements of steps. The drawings are only for purposes of illustrating a preferred embodiment and are not to be construed as limiting the invention.

FIG. 4 illustrates a printhead array aligned with but not engaged with the capping element of FIG. 3;

FIG. 5 illustrates the capping element and printhead array in a sealed capped arrangement;

DETAILED DESCRIPTION OF THE PREFERRED EMBODIMENTS

Figure 1:
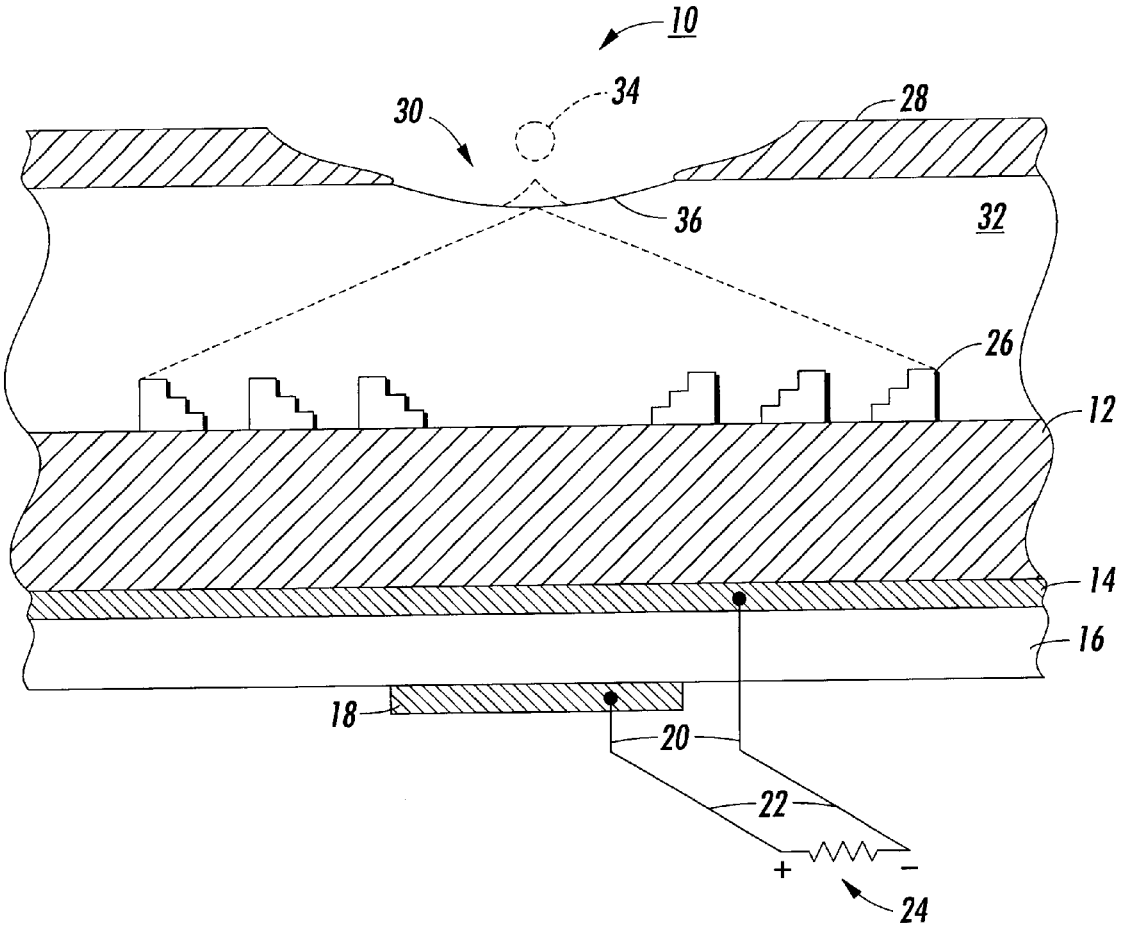
FIG. 1 is a representative illustration of an acoustic ink printing element to which the present invention may be applied.

FIG. 1 provides a view of an exemplary acoustic ink printing ejector 10 to which the present invention is directed. Of course, other configurations may also have the present invention applied thereto. Additionally, while a single ejector is illustrated, an acoustic ink printhead will consist of a number of the ejectors arranged in an array configuration, and the present invention is intended to work with such an array.

As shown, ejector 10 includes a glass layer 12 having an electrode 14 disposed thereon. A piezoelectric layer 16, preferably formed of zinc oxide, is positioned on the electrode layer 14 and an electrode 18 is disposed on the piezoelectric layer 16. Electrode layer 14 and electrode 18 are connected through a surface wiring pattern representatively shown by lines 20 and 22 to a radio frequency (RF) power source 24 which generates power that is transferred to the electrodes 14 and 18. On a side opposite the electrode layer 14, a lens 26, such as a concentric Fresnel lens or other appropriate lens, is formed. Spaced from the lens 26 is a liquid level control plate (also called orifice plate) 28, having an orifice 30 formed therein. Ink 32 is retained between the orifice plate 28 and the glass layer 12. The orifice 30 is aligned with the lens 26 to facilitate emission of a droplet 34 from ink surface 36. Ink surface 36 is, of course, exposed by the orifice 30.

The lens 26, the electrode layer 14, the piezoelectric layer 16 and the electrode 18 are formed in the glass layer 12 through photolithographic techniques. The orifice plate 28 is subsequently positioned to be spaced from the glass layer 12. The ink 32 is fed into the space between the orifice plate 28 and the glass layer 12 from an ink supply (not shown but such supply is well known in the art).

Figure 2:
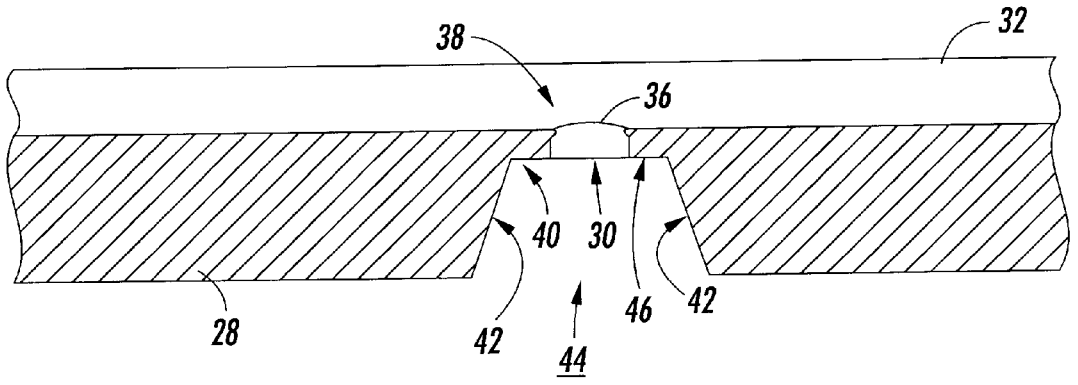
FIG. 2 is an orifice plate which is maintained by operation of the present invention.

Turning attention to FIG. 2, the orifice plate 28 shown is illustrated in more detail, wherein a submerged menisci 38 is maintained at an entrance edge of orifice plate 28 defined by a thin orifice lip 40. During the course of printing with the submerged menisci 38, the inside walls 42 of orifice bore 44 of each orifice 30, as well as the exit surface 46 of the orifice lip 40 can get dirty. As previously noted, due to the unique configuration of the orifice plate 28, existing wiper blade cleaning and other cleaning technology is not sufficient to ensure that an acoustic ink printhead will be sufficiently cleaned so as to assure operational reliability.

Figure 3:
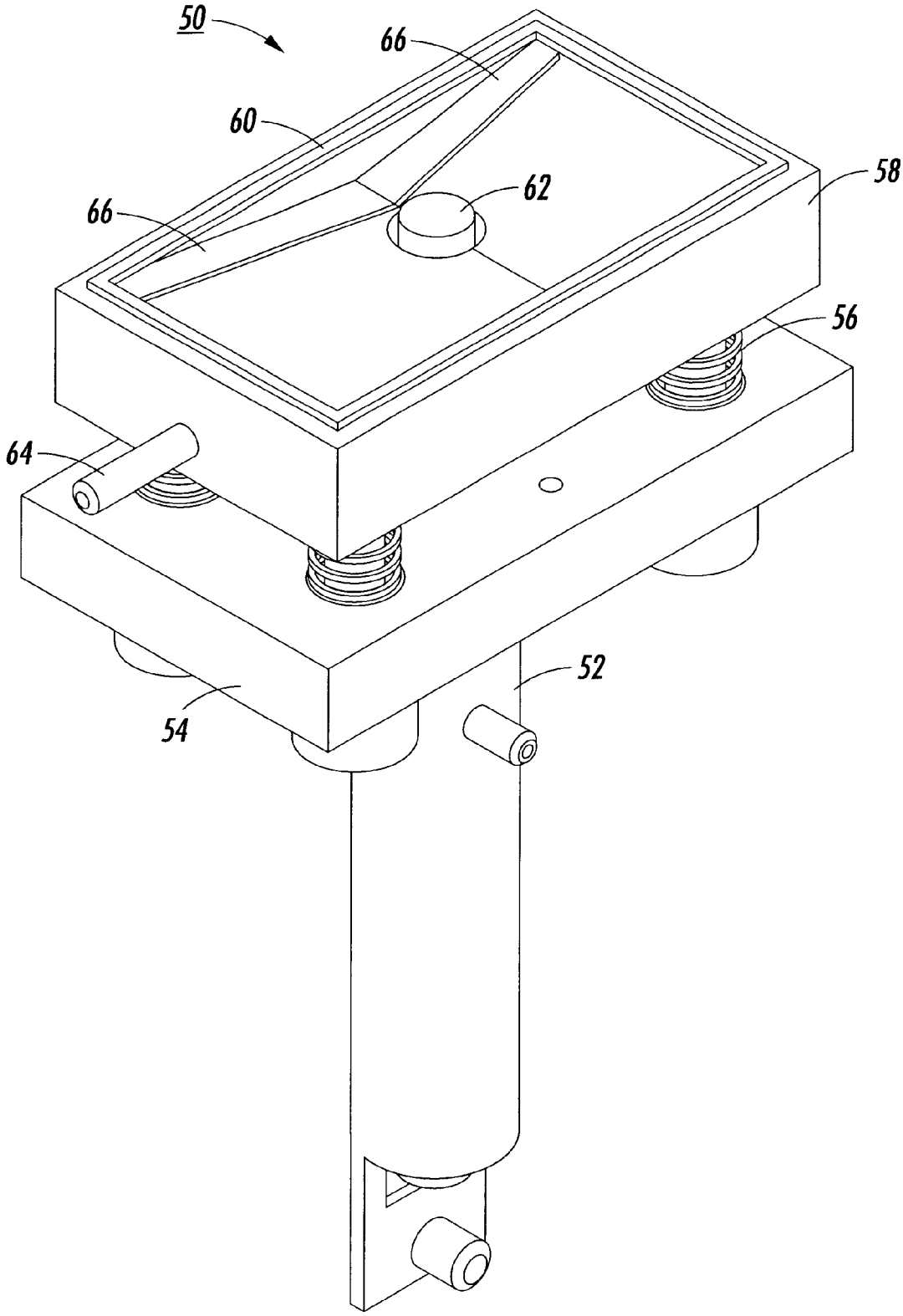
FIG. 3 depicts a capping element used as part of the apparatus and method of the present invention.

In seeking a manner of appropriately cleaning acoustic ink printheads such as those having an orifice plate 28 depicted in FIG. 2, applicants have enlisted the physical component of a capping structure such as that depicted in commonly assigned U.S. patent application Ser. No. 09/340,938, AA Method And Apparatus For Filling And Capping An Acoustic Ink Printhead (filed Jun. 28, 1999), hereby incorporated by reference. This application discloses a capping structure 50 for rapidly filling an acoustic ink jet printhead, such as shown in FIG. 3. The capping structure 50 includes a plunger 52, a base 54, and springs 56 attached to a cap portion 58. The cap 58 includes a gasket seal 60, a valve 62, a drain nozzle 64 and wiper blades 66. During a filling operation, the gasket seal 60 is pressed against an orifice plate such as 28, but having an array of orifices 30. This traps a small volume of air around the orifices 30. During the fill/refill when ink enters the printhead the trapped air-cushion prevents the ink from exiting the orifices. The ink preferentially fills the printhead and exits the outlet path with no ink being spilled outside of the orifice hole. More details regarding the functioning of the capping structure for the fill/refill operations are disclosed in the co-pending U.S. patent application Ser. No. 09/340,938.

In the present invention, capping station 50 is used in a first step of cleaning an acoustic ink printhead, such as comprised of a plurality of ejectors 10 previously described. As shown in FIG. 4, capping structure 50 is moved into alignment with printhead array 70, having a plurality of orifices 30, in a manner known within the art. Next, and as shown in FIG. 5, capping structure 50 is engaged with printhead 70 such as to form a seal. For the cleaning operation of the present invention, once the dirty printhead is capped, the ink pressure in the printhead is increased significantly to allow ink to escape through the orifices and completely fill a small space or gap 72 inside capped structure 50. It is to be appreciated that increasing ink pressure within the printhead is a known technique and accomplishable by one of skill in the art and understanding of acoustic ink printing.

Once the pressure has been increased to move the ink through the orifice structures, the orifices may be allowed to soak for a predetermined time period in order to attempt to dissolve dried ink and loosen dust debris. After a predetermined time period, vent valve 62 is opened to drain the ink through drain nozzle 64 which had been forced by pressure out of the ink printhead. Once the ink has been pushed out through the orifices, the ink pressure inside the printhead is lowered to an intermediate higher level. This pressure prevents the ink still remaining inside the bore 44 of each orifice 30 (see FIG. 2) from reentering the printhead 70. Following this operation, the outside surface of the orifice plate may be cleaned off by wiping with the wiper blade 66. One embodiment of the wiper blade as a part of the cap chamber is disclosed in the aforementioned co-pending U.S. patent application Ser. No. 09/340,938.

Figure 6:
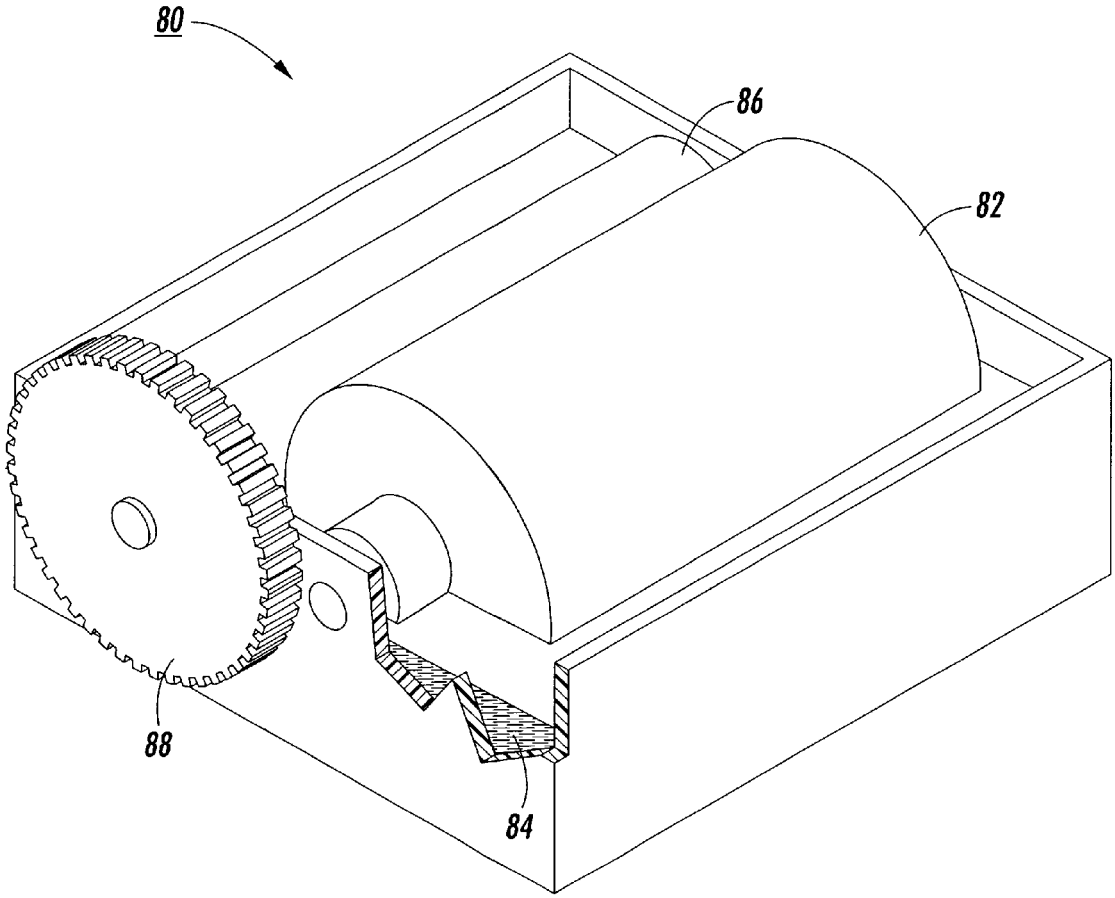
FIG. 6 illustrates a first embodiment of the AIP printhead wiping station according of the present invention.

Once the effort to clean the printhead 70 by flooding has been completed, additional cleaning is undertaken through the use of the wiping station 80 as shown in FIG. 6. It is to be appreciated that wiping station 80 of FIG. 6 may be part of the capping station or may be located at a separate area of the acoustic ink printer mechanism.

AIP printhead wiping station 80 is designed to allow automatic self-cleaning to a cleaning element of the wiping station 80. The cleaning element in the present embodiment is a highly absorptive, hydrophilic and compliant material such as foam or sponge configured as part of a roller assembly 82. The sponge/foam roller 82 works in combination with washing fluid 84, and squeegee 86 to efficiently clean acoustic ink printheads 70. Drive gear 88 is representative of an entire gear system which acts to motivate roller 82 and squeegee 86. However, for the sake of convenience specific gearing is not shown, although it would be obvious to one of ordinary skill in the art to provide such a gearing arrangement. While a single squeegee 86 is illustrated in this figure, it is to be appreciated that multiple squeegees may be used in accordance with the teachings of this invention. Further, in place of a roller design, squeegee 86 may be configured in the form of a squeegee blade or other known design which would appropriately remove excess fluid.

Figure 7:
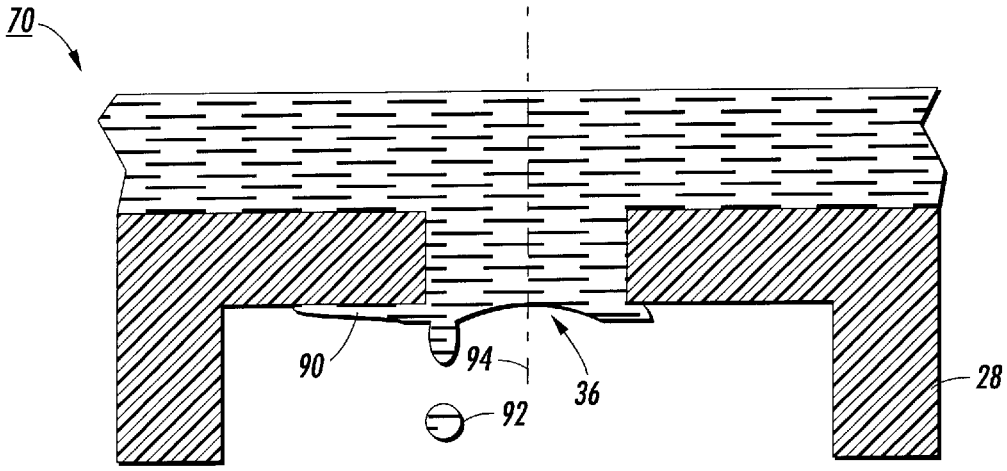
FIG. 7 depicts an ink-jet printhead prior to cleaning.

Turning more specifically to the function of wiping station 80, attention is drawn to FIG. 7 which illustrates a printhead 70 with undesirable dried ink/debris 90 on its surface, whose existence may cause misdirectionality due to interference with the meniscus 36. The meniscus 36 is shown to be held within orifice plate 28 of printhead 70. As can be seen by FIG. 7, ejected ink droplets 92 do not emit from the center 94 of meniscus 36, resulting in undesirable marking. Therefore, the cleaning of the present invention removes the dried ink/debris in order to improve the directionality of ink droplets 92.

Figure 8:
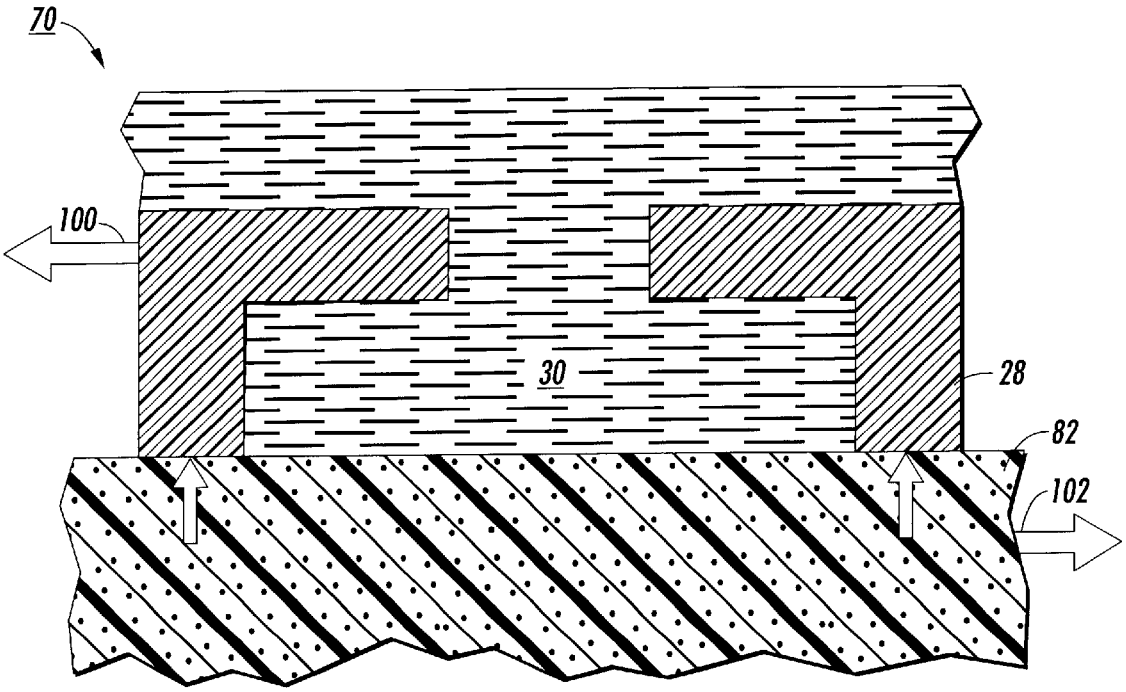
FIG. 8 depicts a first step of the printing process according to the present invention.

As previously discussed, the present invention may be used in conjunction or alone with the flooding operation of capping structure 50. In either case, when activated, AIP wiping station 80 is moved into engagement with printhead 70. Particularly, the AIP printhead wiping station 80 provides a two-step process to remove the dried ink/debris 90 shown in FIG. 7. In the first step, the ink flow rate of the printhead which normally operates, in one embodiment at 150 ml a minute, is increased to a higher rate, for example in this embodiment 190 ml a minute. As shown in FIG. 8, this increased pressure acts to flatten the meniscus 36 pushing ink out of printhead 70. The roller 82 is engaged over orifice 30, while printhead 70 is moving in a first direction 100, in this embodiment at a printhead wipe speed for high flow operation of 0.50 inches per second (ips). At the same time, roller 82 is moving in an opposite direction 102 at approximately a speed of 0.25 ips. The force with which the roller 82 is pressed against the orifice plate is approximately between 230 and 300 gmf.

The action of wiping station 82 is two-fold. The first function is to dissolve dried ink/debris 90 from the orifices as well as the front surface of the printhead 70. The other function is to transport the dissolved ink and contaminants away from the orifices and the front face of the printhead 70. This is achieved by a varying combination of wet wiping; ink flow rates in the printhead, and translating the printhead at an appropriate speed during the wet wipe cycle, in a direction opposite wiping station 80. A unique aspect of the wet wipe scheme of the present invention is that the meniscus unlike other ink jet technologies is on the back side of the orifice plate 28 which requires the wet wipe to extend into the structure to remove contaminants and excess ink from the orifices.

During the process in FIG. 8, the highly absorptive, hydrophilic and compliant material, i.e. the foam or sponge in the form of a roller 82, is pre-moistened in washing fluid container 84 of FIG. 6. Roller 82 is then dragged and squeezed over the orifice structure of the printhead to clean and remove the dried ink and debris off the orifices. The foam or sponge containing the debris and dirty ink is then immersed in the wash fluid 84 to remove the contamination and is next squeezed/pinched between the squeegee 86 to remove excess fluid in preparation of readying foam/sponge roller 82 for further cleaning/contact with the orifice structure of printhead 70.

Thus, in this first step, the foam/sponge roller 82 is cleaned by passing through washing fluid container 84 and then being squeezed or pinched by squeegee 86, to remove excess washing fluid retained from the previous washing/cleaning zone. Increasing the pressure within printhead 70 causes the ink to come out of the printhead 70 and is absorbed by foam/sponge roller 82.

Figure 9:
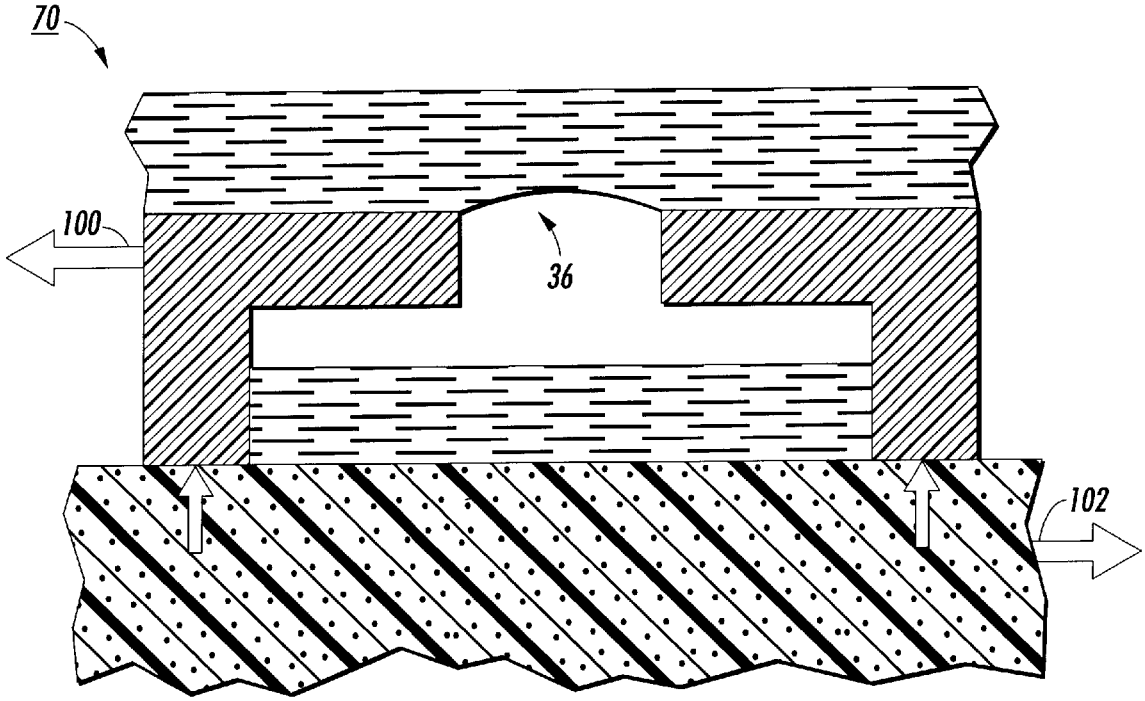
FIG. 9 depicts a second step of the cleaning procedure of the present invention.

Following this initial high cleaning action, the ink pressure within printhead 70 is decreased, as shown in FIG. 9. In this step of the embodiment the low ink pressure is approximately 75 ml per minute which results in retracting the meniscus 36 within printhead 70. During this second wiping step, a force is applied by roller 82, e.g. 230–300 gmf range, and minimal amounts of ink will exit the printhead 70. This step is useful in removing any left over ink as well as assists in drying of printhead 70.

It is noted that during this second step, the movement between printhead 70 and roller 82 is maintained differentially 100, 102. However, the printhead wipe speed in this low-flow situation is 0.1250 ips and the speed of roller 82 is maintained at 0.25 ips.

Once the second step has been completed, wiping station 80 is disengaged from printhead 70. At this time, wiping station 80 may continue to rotate roller 82 through washing fluid container 84 and past engaged squeegee 86 for several additional rotations. The rotations are continued in order to ensure a complete cleaning of the roller 82. As will be discussed in greater detail below, once roller 82 is satisfactorily cleaned, squeegee 86 may be disengaged from contact with roller 82, and roller 82 may be removed from washing fluid container 84. The disengagement and movement of parts may be accomplished by known mechanical configurations.

It is noted that for proper operation, it is desirable that pressure within the printhead 70 relative to the pressure applied by roller 82 is such that ink will move out of printhead 70 and washing fluid will not pass into printhead 70. Specifically, it is desirable that washing fluid does not enter the printhead and thereby dilute the ink. It is to be noted that in a preferred embodiment the area of cleaning would be approximately 5 mm for a particular orifice and a complete orifice plate is anticipated at being approximately 32 mm in length.

In one embodiment, it would be desirable to ensure that the diameter of the roller is sufficient so that an area of the roller only cleans the surface of the printhead once during a specific cleaning operation. This design will ensure repeated washing of roller 82 prior to again being used to clean printhead 70. This ensures that roller 82 will be clean each time it engages with a surface of the printhead 70.

As an aspect of the present invention is to provide a compact cleaning device, it is desirable to minimize the size of the roller 82. However, when roller 82 is made too small of a diameter, there may be insufficient distance between the washing fluid and squeegee 86 to remove a sufficient amount of fluid from the roller prior to engaging printhead 70. In this instance, a further embodiment of operation includes moistening of roller 82 in washing fluid container 84, and thereafter disengaging roller 82 and washing fluid container 84.

The next step rotates roller 82 through squeegee 86 a predetermined number of times in order to provide sufficient removal of liquid. Thereafter, the moistened but non-saturated roller 82 is moved into contact with the printhead 70 for cleaning.

Figure 10:
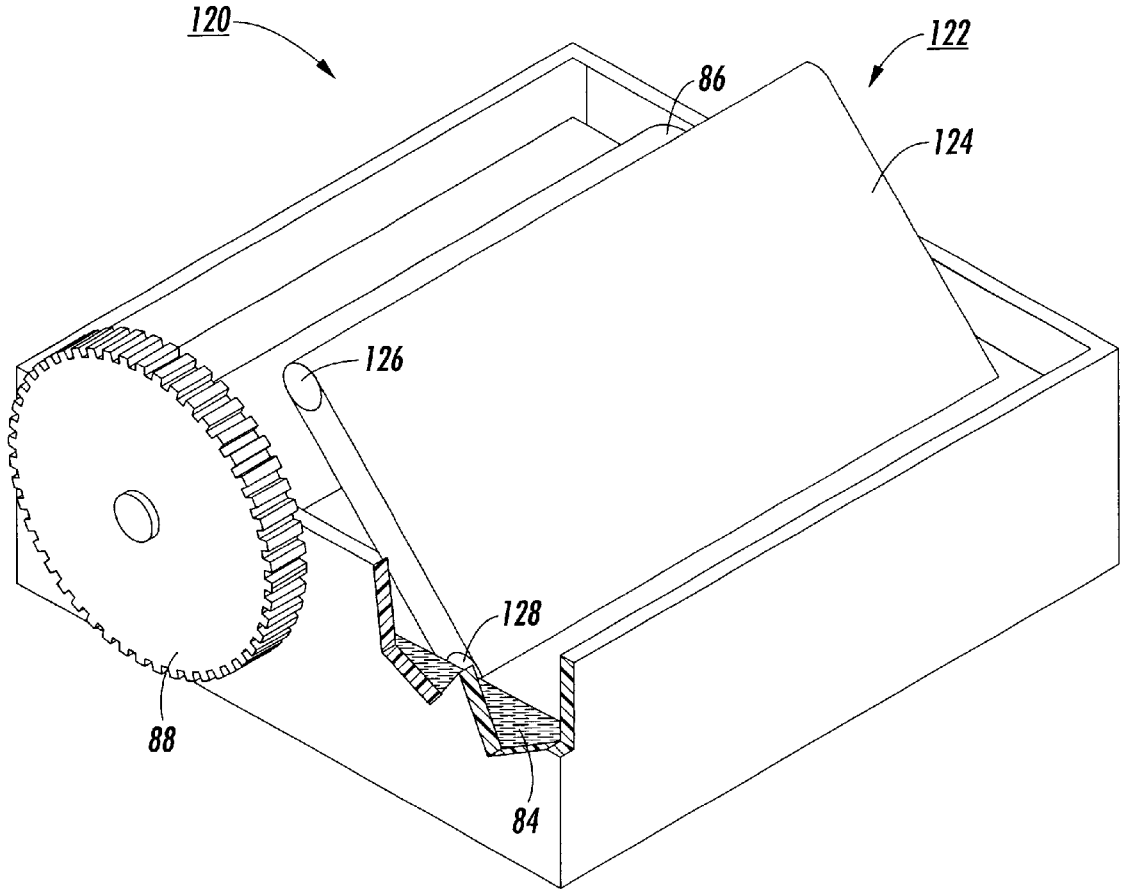
FIG. 10 depicts a second embodiment of an AIP printhead wiping station according to the teachings of the present invention.

Turning to FIG. 10, illustrated is a second embodiment of a wiping station 120. This embodiment is substantially similar to the embodiment of wiping station 80 of FIG. 6. However, herein roller 82 is replaced with a belt mechanism 122 wherein a belt made of a highly absorptive, hydrophilic and compliant material such as a foam or sponge 124 is arranged around rollers 126 and 128. In this embodiment, foam/sponge belt 124 engages the washing fluid container 84 when in the area of roller 128. The printhead cleaning operation described previously in connection with the wiping station 80 of FIG. 6 is equally applicable to that of the present shown embodiment of FIG. 10. Further, belt 124 is also cleaned by the wiping station 120 by a procedure discussed in connection with the cleaning of roller 82 of FIG. 6.

In use of either roller 82 or belt assembly 122, with the speeds discussed in the previous embodiment, it is anticipated that one pass of the wiping station 80 across the surface of printhead 70 is from 2–5 seconds. It has also been determined by the inventors that it is desirable to clean a printhead 70 at least once a day in a printing system. Since there will be two passes for a cleaning process, the entire cleaning process would result in engagement of the roller 82 or belt 122 with printhead 70, for approximately 4–10 seconds a day.

It is also noted that when selecting the proper operational parameters the highly absorptive hydrophilic and compliant material 82 or 124 needs to have a proper absorption rate. If material has too little absorbency it will not hold sufficient washing fluid and will not be able to pull sufficient ink out of the printhead for proper cleaning. On the other hand, an overly absorbent material will inhibit the thorough cleaning of the roller or belt for additional cleaning operations. While the absorption rates will vary dependent upon specific parameters, including ink flow and velocity between the printhead and the roller or belt, with regard to one embodiment, an appropriate absorption rate for an anticipated embodiment is within the range of 50–250 seconds hydrophilicity (also called wet-out, a standard commercial foam specification, measuring absorption time of a known volume of water), and more preferably between 100–110.

With attention to relative speed of the printhead and roller or belt during the cleaning process, it is noted that a slower speed improves the cleaning process, but also increases the amount of ink removed from the system. Therefore the present invention has applied optimal characteristics for desired cleaning with minimal ink loss. Using the parameters discussed above, a relatively small amount of ink is removed from the printhead during each printing process. During testing of the present invention, the inventors have found that less than ¼ml of ink is used during each cleaning process, i.e. including both a first and second pass.

Cleaning station 80 may be used to clean more than a single printhead 70, and may also be employed to clean printheads of different colors. This capability exists due to the fact that the cleaning process ensures that cleaning fluid does not enter into a printhead 70 being cleaned. Since the washing fluid does not enter the printhead 70, there is an assurance that the ink in the printhead will not be diluted with the cleaning fluid or other colored ink. Thus, as long as the printheads are using inks which are compatible when mixed together within the washing fluid, the present invention may be used to clean a variety of printheads including those employing different colors.

The inventors have also determined that a washing fluid may be used in the cleaning process which has up to 15% of its volume as ink.

Figure 11:
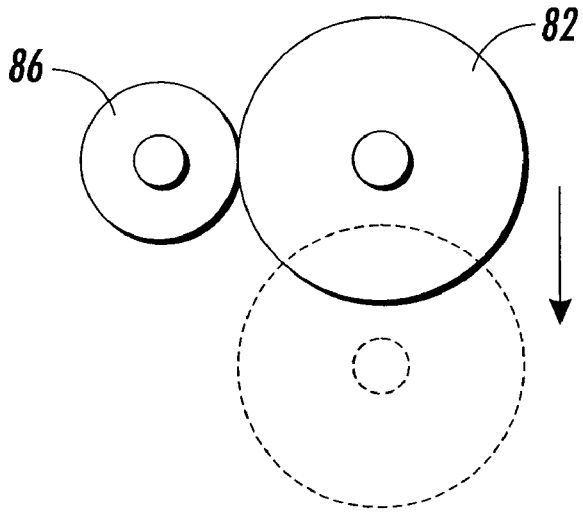
FIGS. 11–13 depict interactions during operation between the squeegee roller, roller and cleaning fluid according to the embodiment of FIG. 6.
Figure 12:
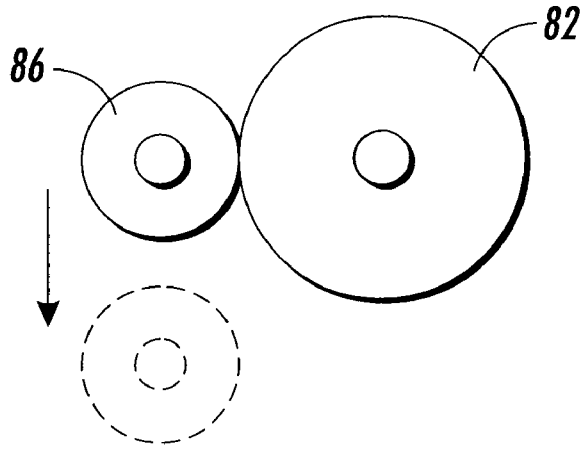
Figure 13:
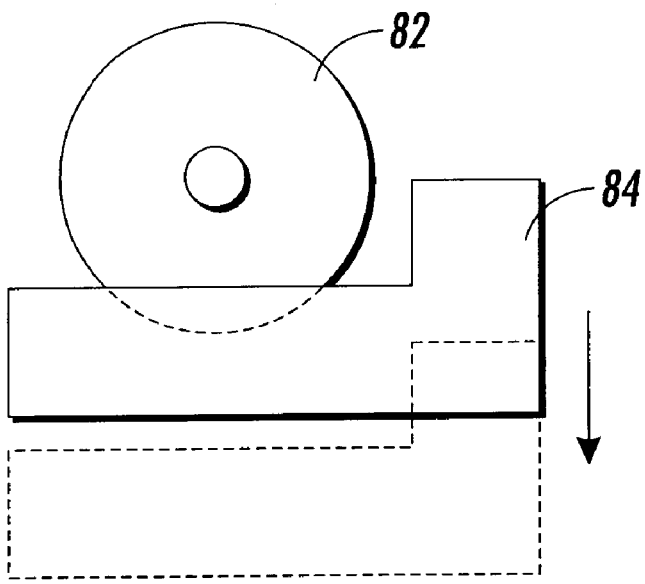

Turning to FIGS. 11, 12 and 13, shown in side view are roller 82 and squeegee 86. Initially, roller 82 is depicted in an engaged position during printhead cleaning, wherein squeegee 86 removes excess moisture from roller 82. Upon completion of the cleaning process, roller 82 moved out of engagement with squeegee 86. This procedure exists so as not to maintain squeegee 86 and roller 82 in permanent contact. As previously noted, the amount of time where actual cleaning occurs within the lifetime of the wiping station 80 is minimal, i.e. 10 seconds a day. Therefore, disengagement between the squeegee 86 and roller 82 is desired so squeegee 86 does not place a permanent indentation in roller 82. FIG. 12 illustrates a further embodiment of this concept, but wherein roller 82 is in a fixed position and squeegee 86 is moved out of engagement. FIG. 13 illustrates a concept wherein the washing fluid container 84 is moved out of engagement with the roller 82. It is to be appreciated that with regard to FIG. 11, since roller 82 is movable the present invention may be designed to have the roller 82 removed from washing fluid container 84.

Figure 14:
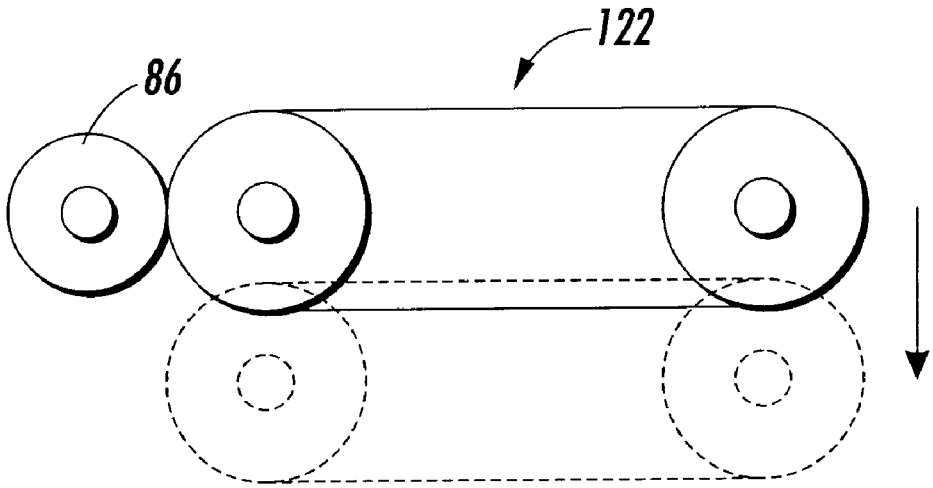
FIGS. 14–17 illustrate the interactions between the squeegee, belt and cleaning fluid of the embodiment of FIG. 10.
Figure 15:
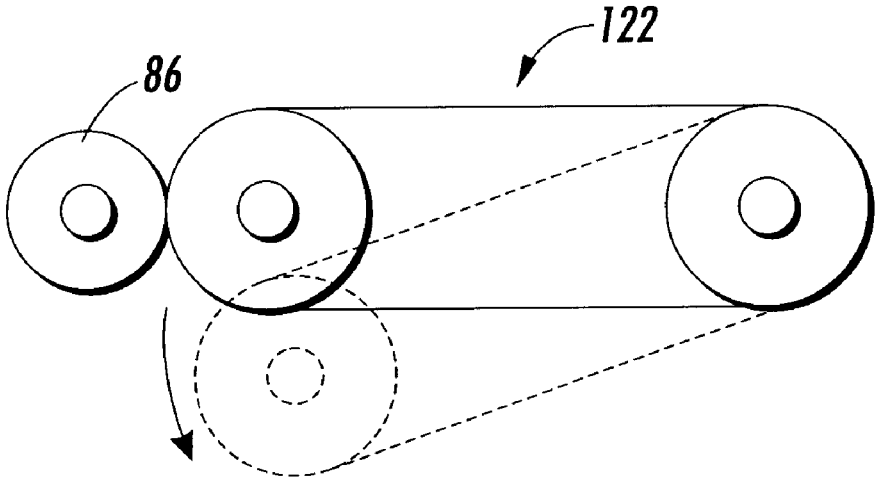
Figure 16:
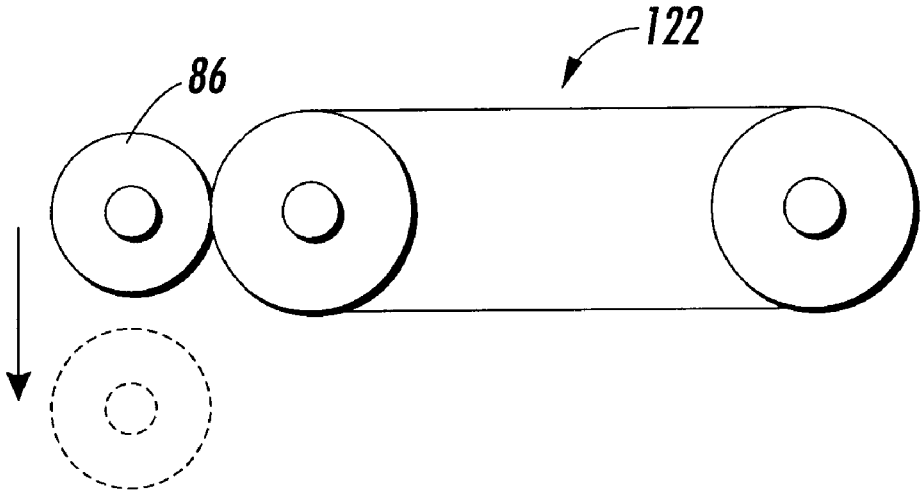
Figure 17:
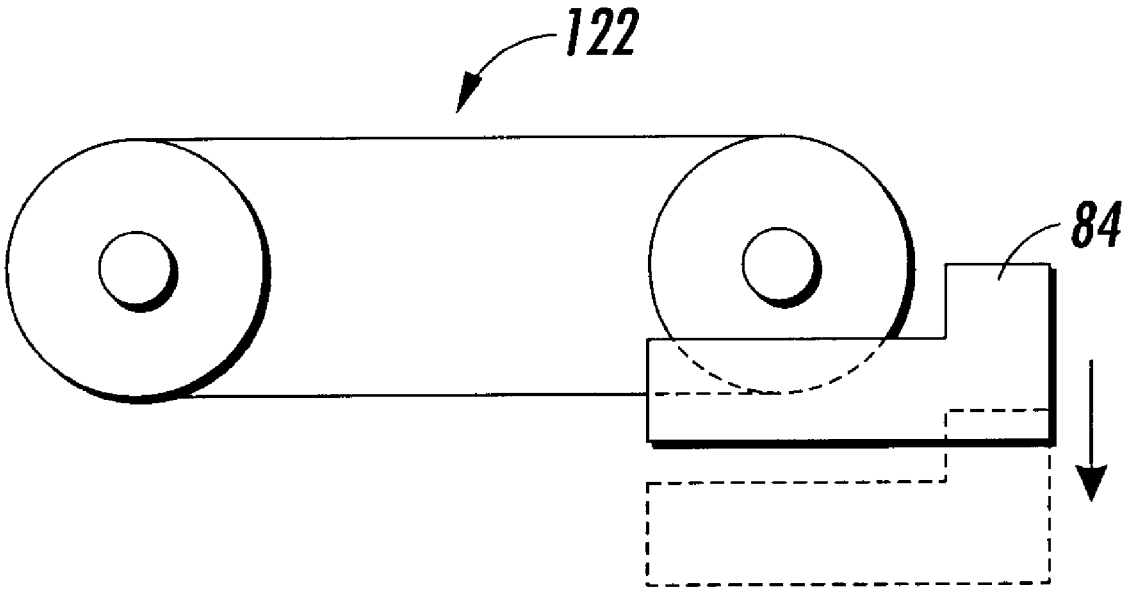

With attention to FIGS. 14 and 15, similar concepts as previously discussed, but in connection with belt assembly 122 are illustrated. In FIG. 14, entire belt assembly 122 is moved out of engagement with squeegee 86 while squeegee 86 is fixed. In FIG. 15, first roller 126 is moved so as to take belt 124 out of engagement with squeegee 86. FIG. 16 illustrates a concept where the belt assembly 122 is in a fixed position and it is squeegee roller 186 which is motivated into and out of engagement. Lastly, FIG. 17 shows an arrangement where washing fluid container 84 is moved out of engagement with belt assembly 122. The movement of the above elements into and out of contact with each other may be accomplished using a variety of known gears and levers, such as but not limited to a knife lever. Also, while the description has discussed ink as the fluid being emitted and cleaned, it is understood that such printheads or emitters may be used in conjunction with other fluids, and the present invention may also be used with such fluids.

The invention has been described with reference to the preferred embodiment. Obviously, modifications and alterations will occur to others upon reading and understanding the preceding detailed description. It is intended that invention be construed as including all such modifications and alterations insofar as they come within the scope of the appended claims or the equivalents thereof.

Having just described the preferred embodiment, the invention is now claimed to be:

1. A method of cleaning an orifice plate which is an upper surface of an acoustic ink printhead, and through which ink droplets are ejected from an ink pool of the printhead, comprising:

wetting an absorbent, hydrophilic and compliant wiping element of a wiping station, by first passing the wiping element through a washing fluid of the wiping station such that an amount of washing fluid is absorbed, and second moving the wiping element into contact with a squeegee element to remove a portion of the absorbed washing fluid;

providing an ink pressure in the printhead which prevents ink from reentering the printhead ink pool;

aligning the wiping station and the printhead such that the wetted wiping element is positioned across from the orifices;

pushing the wiping element over the orifices while the printhead and wiping element are moved in opposite directions, whereby due to the pressure inside the printhead, which does not allow the ink to reenter the printhead, the ink is absorbed by the wiping element;

decreasing the pressure inside the printhead to a value substantially below an operating pressure, whereby menisci retreats inside the orifice lips of the corresponding orifices of the printhead; and pushing a new portion of the wiping element onto the surface of the printhead to absorb remaining ink into the new portion of the wiping element from each orifice as well as from an outer surface of the orifice lips.

2. The method according to claim 1 further including a step of cleaning the wiping element of ink absorbed from the surface of the acoustic ink printhead after the wiping element has cleaned the surface of the acoustic ink printhead.

3. The method according to claim 2 wherein the step of cleaning the wiping element includes moving the wiping element out of contact with the surface of the acoustic ink printhead, moving the wiping element into the washing fluid, and into engagement with the squeegee element, whereby ink absorbed by the wiping element is removed from the wiping element.

4. The method according to claim 1 wherein movement of the wiping element and the surface of the acoustic ink printhead in different directions results in relative velocity between the wiping element and the surface of the acoustic ink printhead.

5. The method according to claim 1 wherein the wiping element is one of a foam and a sponge.

6. The method according to claim 1 further including moving at least one of the squeegee element and wiping element out of contact with each other, after the wiping element has been cleaned, and moving the wiping element and washing fluid out of engagement with each other, after the wiping element has been cleaned.

7. The method according to claim 1 wherein the wiping element is designed to be reused.

8. The method according to claim 1 wherein the wiping element is sized such that one cleaning operation of the printhead will use a portion less than the entire wiping element.

9. The method according to claim 1 wherein the step of cleaning the printhead includes cleaning a plurality of printheads, with at least one of the plurality of printheads having ink of a color different from other printheads of the plurality.

10. A wiping station assembly for cleaning a surface of an acoustic ink printhead, which holds ink between a lower glass substrate and an upper orifice plate, and ejects droplets of the ink through an orifice of the orifice plate when an acoustic wave of a predetermined magnitude is exerted on a free surface of the ink corresponding to the orifice, the wiping station assembly comprising:

an absorptive hydrophilic, compliant movable wiping element;

a washing fluid container holding a washing fluid, configured to receive at least a portion of the wiping element and the wiping element and washing fluid container are configured to be moved into and out of contact with each other;

a squeegee element configured to impinge upon at least a portion of the wiping element; and a gearing arrangement which motivates at least the wiping element, wherein the wiping element moves through the washing fluid thereby absorbing an amount of washing fluid and wherein, of the amount of absorbed washing fluid, a portion thereof is removed by the squeegee element as the wiping element and the squeegee element are moved into contact with each other, the configuration of the wiping element, washing fluid container, and squeegee element causing the wiping station to be a self cleaning wiping station.

11. The invention according to claim 10 wherein the wiping element and the surface of the acoustic ink printhead are designed to move in opposite directions, thereby causing a relative velocity therebetween.

12. The invention according to claim 10 wherein the wiping element is sized such that a same portion of the wiping element does not come into contact with the surface of the acoustic ink printhead during a single cleaning of the surface of the acoustic ink printhead.

13. The invention according to claim 10 wherein the wiping element is configured to pass through the washing fluid and squeegee element a plurality of times after cleaning of the surface of the acoustic ink printhead, in order to clean the wiping element.

14. The invention according to claim 10 wherein the wiping element is one of a roller assembly and a belt assembly.

15. The invention according to claim 10 wherein the wiping element is configured to come into contact with the squeegee element prior to cleaning the surface of the acoustic ink printhead.

16. The invention according to claim 10 wherein the wiping element is reusable for cleaning the surface of the acoustic ink printhead.

17. The invention according to claim 10 wherein the wiping element and squeegee element are configured to be moved into and out of contact.

18. The invention according to claim 10 wherein approximately 0.25 milliliter of ink is removed from the printhead during the cleaning process.

19. A method of cleaning a surface of an acoustic ink printhead which ejects droplets of ink from an ink pool of the printhead through orifices of an orifice plate when an acoustic wave of a predetermined magnitude is exerted on a free surface of the ink corresponding to the orifices, the method comprising:

moving a capping station having a cap portion into alignment with the printhead;

engaging a surface of the printhead and the cap portion so as to create a substantially air tight seal between the surface of the printhead and a surface of the cap portion, with a small gap area existing within the cap portion;

flooding the printhead by increasing ink pressure within the printhead to a level which causes ink to escape through the orifices and filling the small gap inside the cap portion;

maintaining the flooding step for a predetermined amount of time, whereby the ink acts to dissolve dried ink and loosen debris on the printhead;

altering and maintaining the ink pressure to an intermediate level which prevents the ink from reentering the printhead ink pool;

opening a vent valve on the cap portion, to drain at least a portion of the ink which escaped through the orifices;

disengaging the capping station and the printhead;

wetting an absorbent, hydrophilic and compliant wiping element of a wiping station, by first passing the wiping element through a washing fluid of the wiping station such that an amount of washing fluid is absorbed, and second passing the wiping element into contact with a squeegee element to remove a portion of the absorbed washing fluid;

aligning the wiping station and the printhead such that the wetted wiping element is positioned across from the orifices;

a first wiping step including, pushing the wiping element over the orifices, while the printhead and wiping element are moved to cause a relative velocity, whereby due to the pressure inside the printhead which does not allow the ink to reenter the printhead, the ink is absorbed by the wiping element;

decreasing the pressure inside the printhead to a value substantially below operating pressure, whereby menisci retreats inside orifice lips of the corresponding orifices of the printhead;

a second wiping step including, pushing a new portion of the wiping element onto the surface of the printhead whereby remaining ink is absorbed into the new portion of the absorbent material from each orifice as well as from an outer surface of the orifice lips;

returning the ink pressure to normal operating level to enable resumption of printing;

separating the wiping station from contact with the printhead; and cleaning the wiping element of the wiping station, by passing the wiping element into the washing fluid and into contact with the squeegee element a number of times to remove ink absorbed into the wiping element.

* * * * *